US009155934B2

(12) United States Patent
Kassel

(10) Patent No.: US 9,155,934 B2
(45) Date of Patent: Oct. 13, 2015

(54) METHOD OF DOING PUSHUPS AND PUSHUP DEVICE EMPLOYED IN SAID METHOD

(71) Applicant: Bodylastics International, Inc., Boca Raton, FL (US)

(72) Inventor: Blake Kassel, Boca Raton, FL (US)

(73) Assignee: Bodylastics International, Inc., Boca Raton, FL (US)

( * ) Notice: Subject to any disclaimer, the term of this patent is extended or adjusted under 35 U.S.C. 154(b) by 37 days.

(21) Appl. No.: 14/010,661

(22) Filed: Aug. 27, 2013

(65) Prior Publication Data

US 2014/0066274 A1 Mar. 6, 2014

Related U.S. Application Data

(60) Provisional application No. 61/694,457, filed on Aug. 29, 2012.

(51) Int. Cl.

| | |
|---|---|
| ***A63B 21/00*** | (2006.01) |
| ***A63B 23/12*** | (2006.01) |
| ***A63B 21/04*** | (2006.01) |
| ***A63B 21/055*** | (2006.01) |
| ***A63B 21/068*** | (2006.01) |
| ***A63B 23/035*** | (2006.01) |

(52) U.S. Cl.

CPC ..... *A63B 23/1236* (2013.01); *A63B 21/0414* (2013.01); *A63B 21/0442* (2013.01); *A63B 21/0552* (2013.01); *A63B 21/068* (2013.01); *A63B 21/1469* (2013.01); *A63B 23/03541* (2013.01); *A63B 23/1281* (2013.01)

(58) Field of Classification Search

USPC ..... 482/121, 49, 141

See application file for complete search history.

(56) References Cited

U.S. PATENT DOCUMENTS

| | | | | |
|---|---|---|---|---|
| 113,384 | A * | 4/1871 | Barret | 482/126 |
| 1,388,494 | A | 8/1921 | Vala | |
| 3,427,023 | A * | 2/1969 | Silberman | 482/139 |
| 6,186,930 | B1 | 2/2001 | Ignaczak | |
| 6,244,998 | B1 | 6/2001 | Hinds | |

(Continued)

FOREIGN PATENT DOCUMENTS

| | | | |
|---|---|---|---|
| DE | 29610293 | U1 | 10/1996 |
| GB | 2077838 | A | 12/1981 |
| WO | 2010127337 | A2 | 11/2010 |

OTHER PUBLICATIONS

International Search Report for PCT/US2013/057055 dated Nov. 27, 2013.

*Primary Examiner* — Jerome W Donnelly

(74) *Attorney, Agent, or Firm* — Caesasr Rivise, PC

(57) ABSTRACT

Method of doing pushups employs a pair of pushup devices including at least one retainer for receiving a connection member at an end of an exercise band; an elastic exercise band is connected to a retainer of each push up device with the band over a user's back as a user pushes upwardly on the handle sections of the pushup devices a pushup device also constitutes a part of the invention. The pushup device includes a longitudinally extending passage at the lower end of a body section in which an end section of an elastic exercise band is directed when a pushup in accordance with this invention is being carried out. Preferably the pushup device includes a handle section removable from a body section and usable with one or more elastic exercise bands separately from the body section to provide a variety of different exercises other than pushups.

18 Claims, 20 Drawing Sheets

(56) References Cited

U.S. PATENT DOCUMENTS

| | | | |
|---|---|---|---|
| 7,785,243 | B2 | 8/2010 | Kassel |
| 7,819,787 | B2 | 10/2010 | Kassel |
| 7,896,786 | B1 | 3/2011 | Osbourne |
| 2002/0073520 | A1 | 6/2002 | Hall |
| 2007/0037678 | A1 | 2/2007 | Schaefer et al. |
| 2009/0298657 | A1 | 12/2009 | Potok |
| 2010/0137105 | A1 | 6/2010 | McLaughlin |
| 2010/0317496 | A1 | 12/2010 | Abranchess |
| 2011/0009250 | A1 | 1/2011 | Barringer |

* cited by examiner

METHOD OF DOING PUSHUPS AND PUSHUP DEVICE EMPLOYED IN SAID METHOD

RELATED APPLICATIONS

This application is a continuation-in-part application of pending application Ser. No. 61/694,457, filed on Aug. 29, 2012, the subject matter of which is fully incorporated by reference herein.

BACKGROUND OF THE INVENTION

1. Field of Invention

This invention relates generally to a method of doing pushups and to pushup devices and components thereof.

2. Background Art

It is well known in the prior art to employ pushup devices of the type including a body section for engaging the floor or other supporting surface and a handle to be engaged by a person doing pushups. A person intending to do a pushup grips the handle section of two pushup devices to carry out a pushup exercise.

In order to increase the resistance during a pushup users have positioned a stretchable elastic exercise band around their back and have engaged opposed ends of the elastic bands while at the same time gripping the handles of the pushup devices. In this method of carrying out a pushup at least a portion of the opposed ends of the exercise band is positioned adjacent the handle and is retained against the handle by the force of the person's grip. This is an extremely uncomfortable arrangement for carrying out a pushup with an exercise band, and actually can cause blisters and other injuries to the person's hand depending on the level of resistance created by the exercise band.

Even with the use of a single exercise band injury to the user's hands can occur, and clearly, based on the state of the art pushup exercises using multiple elastic bands positioned over the user's back is not feasible or even contemplated.

Exemplary prior art pushup devices are disclosed in Schaffer et al. Publication No. US2007/0037678; Ignaczak U.S. Pat. No. 6,186,930; Potok Publication No. US2009/0298657; Barringer Publication No. US2011/0009250 and International Publication No. WO2010/127337.

The '337 publication discloses a substantially circular pushup device having a body section and a handle section and discloses detachable handles in the paragraph bridging pages 41 and 42 in conjunction with FIGS. 35A, 35B and 35C.

The '337 publication also discloses attaching elastic bands to the body section of opposed pushup devices and describes that arrangement on pages 42 and 43 in conjunction with FIGS. 36A and 36B.

The elastic bands attaching pushup devices together or used in connection with a single pushup device in the '337 publication are intended to introduce resistance to the actual movement of the pushup devices relative to each other or relative to a support member during an exercise. There is no suggestion that an elastic exercise band can be connected between opposed pushup devices and positioned over the back of a user to provide added resistance against a person's body during a pushup exercise.

It also should be noted that in the '337 publication the elastic members are connected to the pushup devices through retaining members on the body section of those devices; not the handle sections. Thus, the handle sections of the pushup devices are not intended to be removed for the purpose of using the handle sections in conjunction with exercise bands to provide any exercises independent of exercises with the disclosed pushup devices.

In other words, the '337 publication does not disclose a method of using a pushup device wherein an elastic band is positioned over a person's back while the person is engaged in a pushup exercise. In addition the '337 publication does not disclose the feature of a removable handle of a pushup device, wherein the removable handle includes a retaining or attachment member for cooperating with retaining or attaching members of an exercise band to thereby permit the handle sections to be used separately with an exercise band for carrying out exercises independent of pushups.

A need exists for an improved method and structure for carrying out pushups wherein one or more elastic bands can be reliably attached to pushup devices in a manner to permit pushup exercises to be carried out with the elastic band positioned over a person's back. In addition, a need exists for an improved method and structure for carrying out pushups wherein one or more elastic bands can be reliably attached to push up devices in different positions for permitting the active length of the elastic band positioned over a person's back to be changed. In addition, a need is believed to exist for pushup devices wherein a handle section is removable from the body section of the pushup devices and is capable of being used with one or more elastic bands to provide exercises independent of pushup exercises.

SUMMARY OF THE INVENTION

A method of doing pushups employing the resistive force of a stretchable elastic exercise band in accordance with this invention includes the steps of: (a) employing a pair of pushup devices, each device including a body section having a lower surface for engaging a support surface and an upper handle section attached to said body section for engagement by a person desiring to do pushups; each device further including at least one retainer for engaging a cooperating connection member of a stretchable elastic exercise band; (b) employing a stretchable elastic exercise band having a connection member at each end thereof, each connection member being engageable with a retainer on each of the pushup devices; (c) engaging the connection member located at one end of the stretchable elastic exercise band with a retainer of one of the pair of pushup devices and engaging the connection member at an opposed end of the stretchable elastic exercise band with a retainer member of the other of said pair of pushup devices and (d) a person desiring to do pushups engaging the handle section of each of said pair of pushup devices with the pushup devices supported on the support surface on opposite longitudinal sides of the person and with the stretchable elastic exercise band positioned over the person's back area with the connection member at each end thereof being engaged with a cooperating retainer on each of the pair of pushup devices, respectively, whereby a person doing pushups experiences a downward resistive force of the elastic exercise band as the person pushes upwardly on the handle sections of said pushup devices.

In one preferred method of doing pushups a plurality of stretchable elastic bands are attached to the pushup devices through the cooperation of connection members of the bands and retainers of the pushup device, including the step of carrying out one or more pushups with a plurality of stretchable elastic bands positioned over the back area of a person doing pushups.

In a preferred method, the handle section of each device is removable from its corresponding body section and includes at least one retainer thereon, including the steps of: removing at least one handle section from its cooperating body section; engaging one or more cooperating connection members of one or more stretchable elastic bands with said at least one retainer on the handle section removed from its corresponding body section and gripping the at least one handle section to carry out one or more exercises other than pushups with the one or more stretchable elastic bands and the at least one handle section engaged thereto.

In a preferred method of this invention, a pair of retainers are provided in spaced-apart relationship on the handle section of each pushup device and the handle sections are removable from their respective body sections, including the steps of removing at least one handle section from its corresponding body section and engaging said at least one handle section with one or more elastic exercise bands connected thereto to carry out one or more exercises other than pushups with the one or more stretchable elastic bands and the at least one handle section attached thereto.

In accordance with the method of this invention retainers for engaging a connection member of an elastic stretchable band can be included on the handle section, on the body section or on both the handle and body section. When it is desired to include a removable handle section on the body section to permit its use with exercise bands when separated from the body section one or more retainers need to be included on the handle section.

This invention also relates to a pair of pushup devices, each device including a body section having a lower surface for engaging a support surface and an upper handle section attached to the body section for engagement by a person desiring to do pushups; each device further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer.

This invention also includes the combination of a pair of pushup devices with at least one stretchable elastic exercise band including cooperating connection members proximate each end thereof, said cooperating connection members at each end of said at least one elastic exercise band being engaged with a retainer of a respective one of said pushup devices with each end segment of said at least one exercise band being disposed in an elongate direction through a passage at a lower end of a respective pushup device.

In the preferred embodiment, a retainer is attached to the handle section of said pushup device, said handle section of each pushup device being removably connected to its corresponding body section, whereby the handle section of each pushup device can be separated from its respective body section and used with one or more elastic exercise bands separately from the body section.

In the preferred embodiment, a pair of retainers are secured respectively at opposed, spaced apart ends of a respective handle section of said pushup device, said handle section of each pushup device being removably connected to its corresponding body section, whereby the handle section of each pushup device can be separated from its respective body section and used independently with one or more elastic exercise bands to carry out exercises.

In the preferred embodiment the body section of each of a pair of pushup devices includes a surface segment spaced upwardly from the lower surface for providing a passage extending in an elongate direction from one end of said body section to an opposed end of said body section, said passage being adapted to receive an end segment of an elastic exercise band therethrough when the cooperating connection member proximate an end of the elastic exercise band is engaged with at least one retainer.

In a preferred embodiment, the body section of each of a pair of pushup devices includes at least one band-impeding member thereon located above the lower surface of the body section that is adapted to engage a support surface and below a surface segment of the body section defining a passage through the body section, the band-impeding member bridging a longitudinal dimension of said passage for engaging an end section of an elastic band extending through said passage within said passage above said impeding member.

In a preferred embodiment the body section of each pair of pushup devices includes at least a pair of band impeding members thereon located above the lower surface of the body section that is adapted to engage a support surface and below a surface segment of the body section defining a passage through the body section, each of said impeding members bridging a longitudinal dimension of said passage for engaging an end section of an elastic band extending through said passage within said passage above said impeding members.

In the most preferred embodiment, one or more band guiding members are provided to cooperate with one or more band impeding members to provide a retainer on the body sections of the pushup devices. Specifically, the cooperating band guiding members and band impeding members are spaced-apart in a vertical direction when the pushup device is supported on a flat, horizontal surface to define a passageway there between through which a body section of an elastic band can extend but having an insufficient dimension to permit a connection member adjacent the end of the elastic band from passing therethrough. Thus, the cooperating band guiding member and band impeding member constitute a retainer on the body section of the pushup device for engaging the connecting member located adjacent an end of the elastic band to thereby retain he elastic band in a proper position on the pushup devices during a pushup exercise, as will be discussed in greater detail hereinafter. In accordance with this embodiment the active length of the elastic band for positioning over a user's back can be varied by either attaching a carabineer at the end of the band to retainer in the form of an attachment ring associated with the handle, or by maintaining the elastic band in a position wherein the carabineer is disconnected from the attachment ring and the retainer provided by the cooperating guide member and band impeding member engages a connection member on the band, which is an enlarged diameter portion of the band inwardly of the carabineer, to thereby retain a desired connection between the pushup device and the elastic band.

In accordance with the broadest aspects of this invention one or more retainers can be provided on the handle section, on the body section, or on both the handle and body section. Most preferably at least one retainer is provided on both the handle section and the body section to permit adjustment of the effective length of the exercise band to be positioned over a user's back during an exercise operation. In the most preferred embodiment the handle section also is removable from the body section so that it can be separated from the body section and employed independently with one or more elastic bands to provide exercises other than pushups.

In the most preferred embodiment of the invention, one or more band impeding members that are located above the lower surface of the body section that is adapted to engage a support surface and below a surface segment of the body section defining a passage through the body section is/are pivotally attached to the body section adjacent one longitudinal end of the passage. This arrangement is preferred whether or not a band guiding member is provided to cooperate with the impeding member to provide a retainer as part of the body section, independent of a retainer that is provided on the handle section in the form of an attachment ring for engaging a carabineer on the band.

Most preferably, when one or more band impeding members are included in the construction they are normally biased downwardly about its pivotal attachment to provide open, uninterrupted access into the passage from the bottom thereof, said body section and said at least one impeding member having cooperating retaining members for retaining the impeding member in a closed position substantially parallel to said support surface for the pushup devices. This arrangement is preferred whether or not a band guiding member is provided to cooperate with the impeding member(s) to provide a retainer attached to the body section independent of a retainer in the form of an attachment ring attached to the handle section for engaging a carabineer on the band.

Other objects and advantages of this invention will become apparent by referring to the description of the drawings which follows taken in conjunction with the detailed description of the preferred embodiments of this invention.

BRIEF DESCRIPTION OF THE DRAWINGS

The invention will be described in conjunction with the following drawings in which like reference numerals designate like elements and wherein.

DESCRIPTION OF PREFERRED EMBODIMENTS OF THE INVENTION

Figure 1:
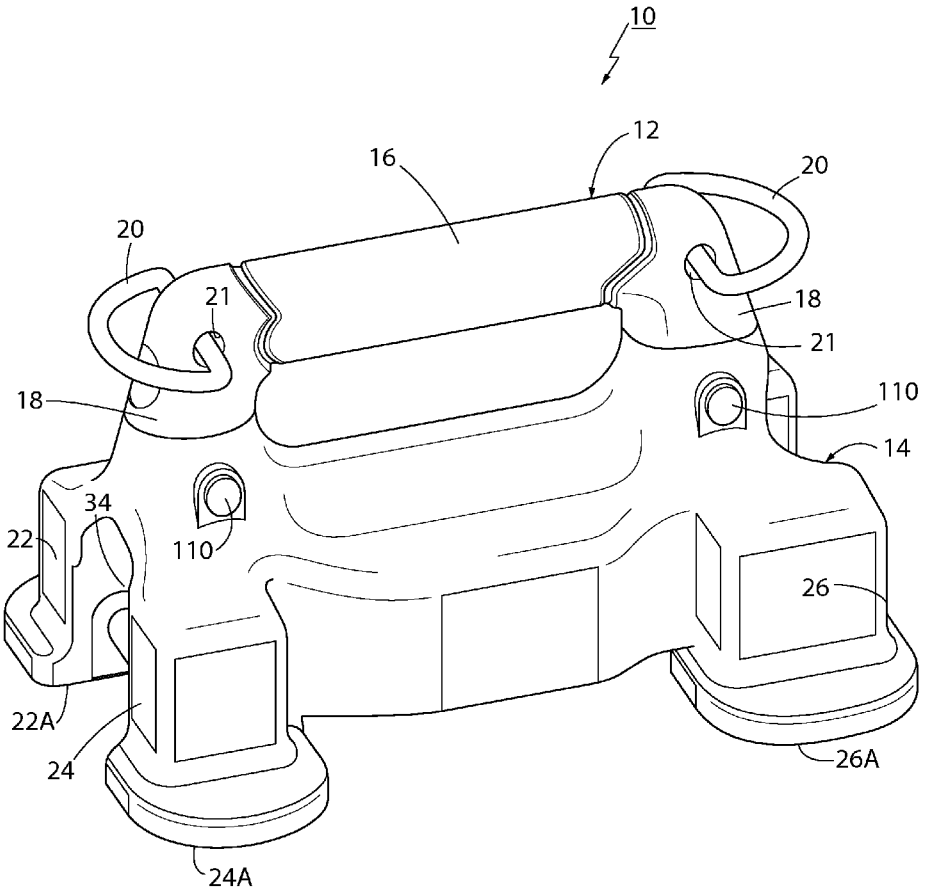
FIG. 1 is an isometric view of a pushup device in accordance with this invention.
Figure 2:
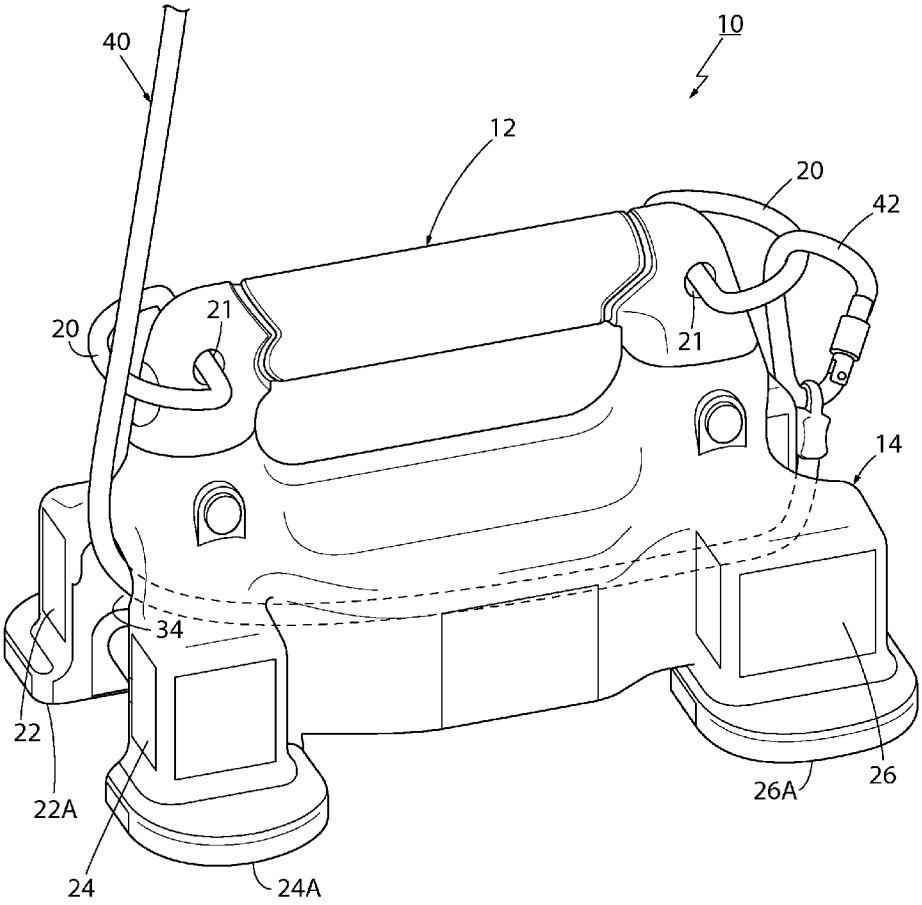
FIG. 2 is an isometric view of a pushup device in accordance with this invention in combination with an elastic exercise band.
Figure 3:
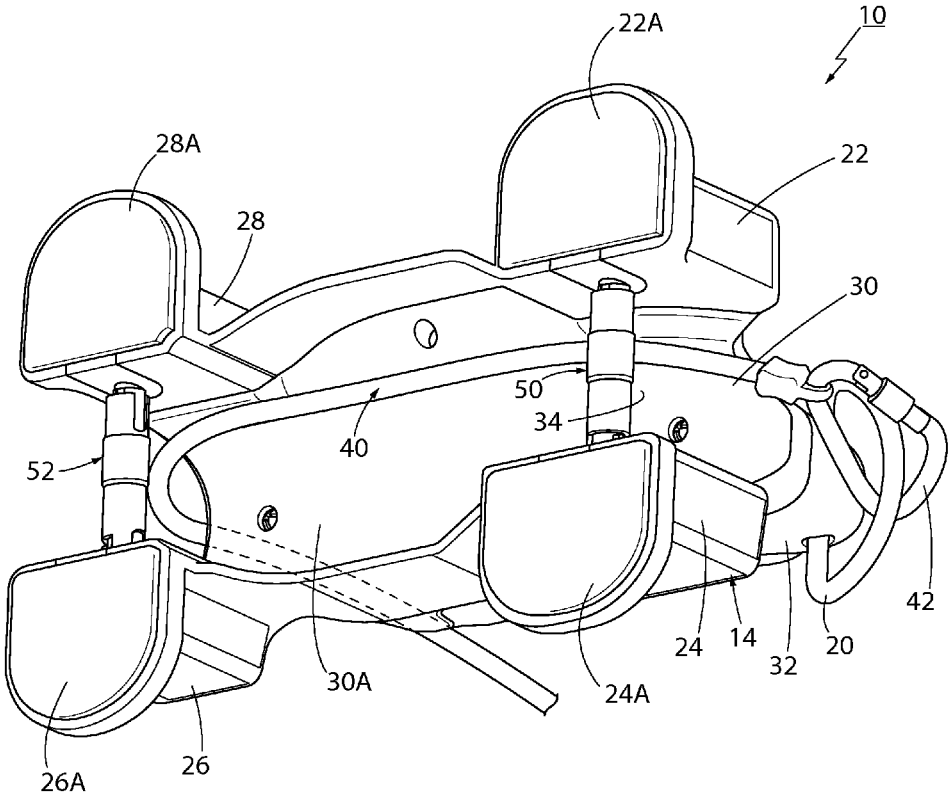
FIG. 3 is an isometric view of the embodiment illustrated in FIG. 2, but viewed from the lower surface of the pushup device.

A pushup device in accordance with one embodiment of this invention is generally shown at 10 in FIGS. 1-3. The pushup device includes a handle section 12 that is removably secured to a body section 14 in a manner that will be described in detail hereinafter.

The handle section 12 includes a horizontal section 16 and longitudinally spaced-apart leg sections 18. It is the spaced-apart leg sections that are releasably attached to the body section 14, as well be described in detail later in this application.

As can be seen best in FIGS. 1 and 2 a pair of retainers in the form of D rings 20 are secured through passages 21 in the handle section generally located at the junction between the horizontal section 16 and the leg sections 18. In accordance with the broadest aspects of this invention the pushup device 10 can include only a single retainer in the form of only one D ring attached through a single passage provided at the junction of the horizontal section 16 and one of the spaced-apart leg sections 18.

As can be seen best in FIG. 3, the body section 14 of the pushup device includes spaced-apart legs 22, 24, 26 and 28 including lower surfaces 22A, 24A, 26A and 28A, respectively for engaging a support surface (e.g., floor, platform, etc) when the pushup device 10 is being used.

Referring specifically to FIG. 3, the body section 14 includes an injection molded lower plate 30 that is bolted to the underside of a injection molded upper body segment 32 by any suitable fastening means, to provide a smooth, downwardly facing surface 30A.

As can be seen best in FIGS. 1-4, the downwardly facing surface 30A in conjunction with surfaces of the spaced-apart legs 22, 24, 26 and 28 provide an elongate passage 34 extending in a longitudinal direction through the pushup device 10.

Figure 10:
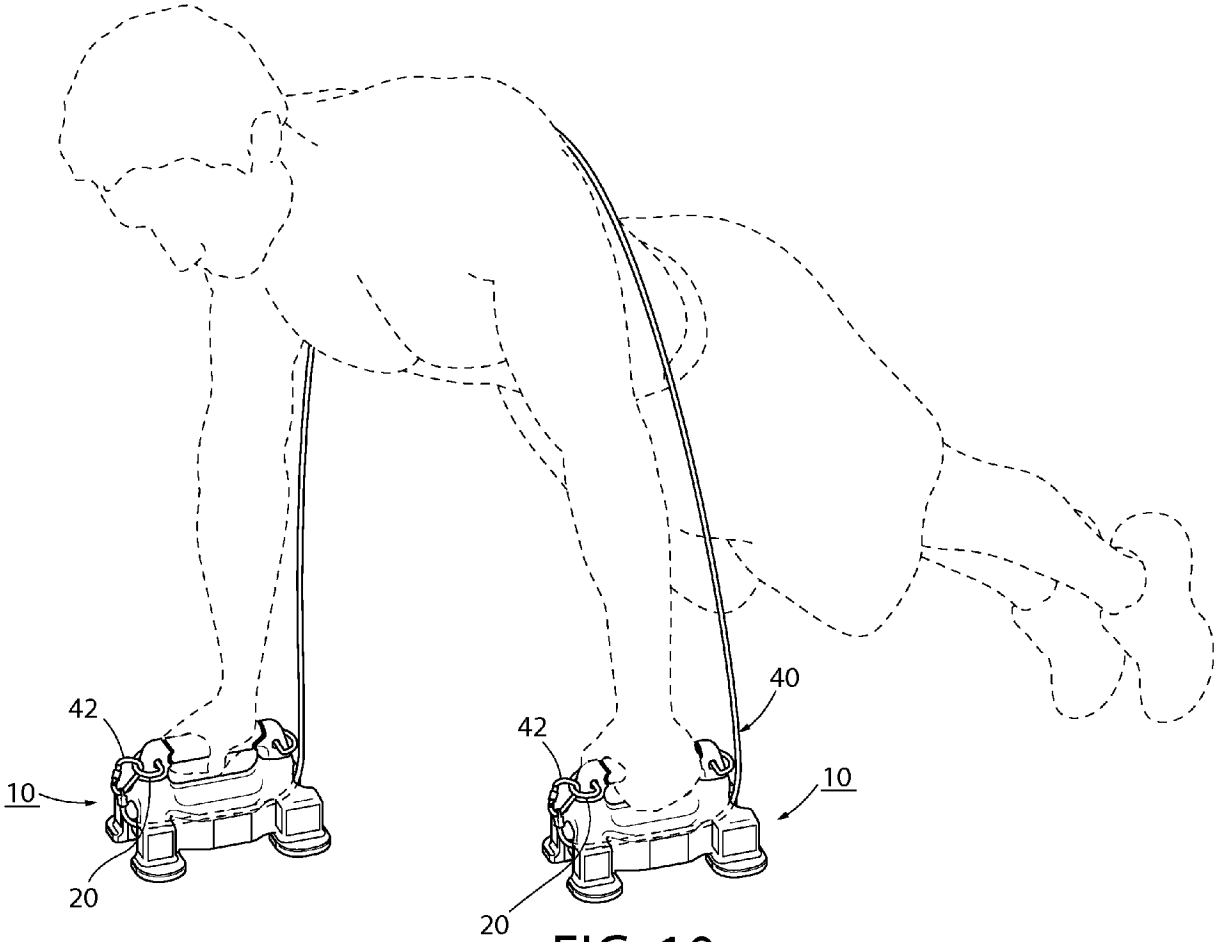
FIG. 10 illustrates a preferred method of carrying out a pushup in accordance with this invention, with an elastic band attached to a pair of pushup device and extending over the back area of a person carrying out a pushup.

Referring to FIGS. 2, 3 and 10, a representative use of the pushup device 10 with an elastic exercise band 40 in accordance with this invention is illustrated. As illustrated the elastic exercise band 40 includes a conventional connection member 42 in the form of a carabineer that is removably attached to or engaged with one of the D rings 20. The band is then passed through the passage 34, which functions to take up some of the length of the exercise band so that a conventional exercise band can be employed in accordance with the preferred method of this invention, as will be described hereinafter with respect to FIG. 10.

Referring to FIG. 10, a preferred method of carrying out a pushup exercise is illustrated with the elastic exercise band 40 connected to a D ring 20 of each of the pushup devices 10 and the main body of the elastic exercise band passing over the exerciser's back. As noted above, the exercise band passes through the longitudinally extending passage 34 to thereby permit an elastic exercise band 40 of a conventional length (e.g. approximate 4 feet) to be employed by taking up undesired excessive length within the confines of the passage. Moreover, by passing the elastic exercise band 40 through the passage 34 the force imposed upon the elastic band as it is being stretched during the upward movement of a pushup is distributed over the longitudinal dimension of each exercise device, as opposed to being isolated at a single point or location. This is an advantageous feature of the present invention.

Referring to FIG. 3, a pair of longitudinally spaced-apart band impeding members 50, 52 are shown in a closed position spaced from the downwardly facing surface 30A defining an upper surface of the passage 34. As can be seen in FIG. 3, the elastic exercise band 40 is passed through the passage 34 above the band impeding members 50, 52. Thus, the band impeding members prevent the elastic exercise band from moving out of its position within the passage 34 as the pushup device is being positioned, repositioned or otherwise manipulated or moved by an individual intending to do pushups.

Each of the band impeding members 50, 52 is of an identical construction. Therefore, the description that follows will be limited to the construction and operation of the band impeding member 50, it being understood that the construction and operation of the band impeding member 52 is identical.

Figure 4:
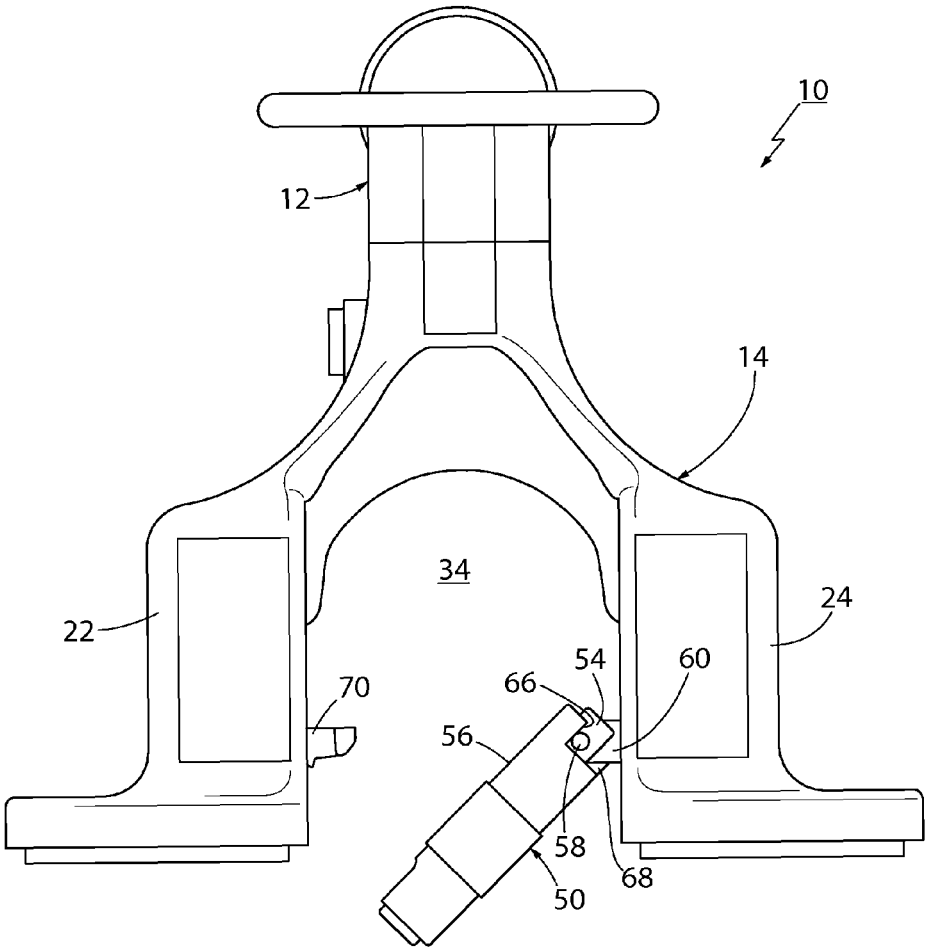
FIG. 4 is an end elevational view of the pushup device shown in FIG. 1 with a band impeding member biased into a downwardly, open position.

Referring to FIG. 4, the banding impeding member 50 is shown in its normally biased, open position. In this position the exercise band can be easily inserted into the passage 34 from the underside thereof, thereby avoiding the necessity of threading the band longitudinally through the passage. However, in accordance with the broadest aspects of this invention the band impeding members can be permanent, non-moveable members to provide their band impeding function. In this latter embodiment the exercise band will need to be threaded through the passage 34, and will not be insertable into the passage from the lower surface of the pushup device 10.

The preferred band impeding member 50 is of a construction very similar to that employed in a locking member or arm of a known carabineer construction, with the major difference being that the band impeding members in the pushup device 10 of this invention are normally biased into an open position, whereas in the prior art carabineer construction the closing member normally is biased into a closed position.

Figure 5:
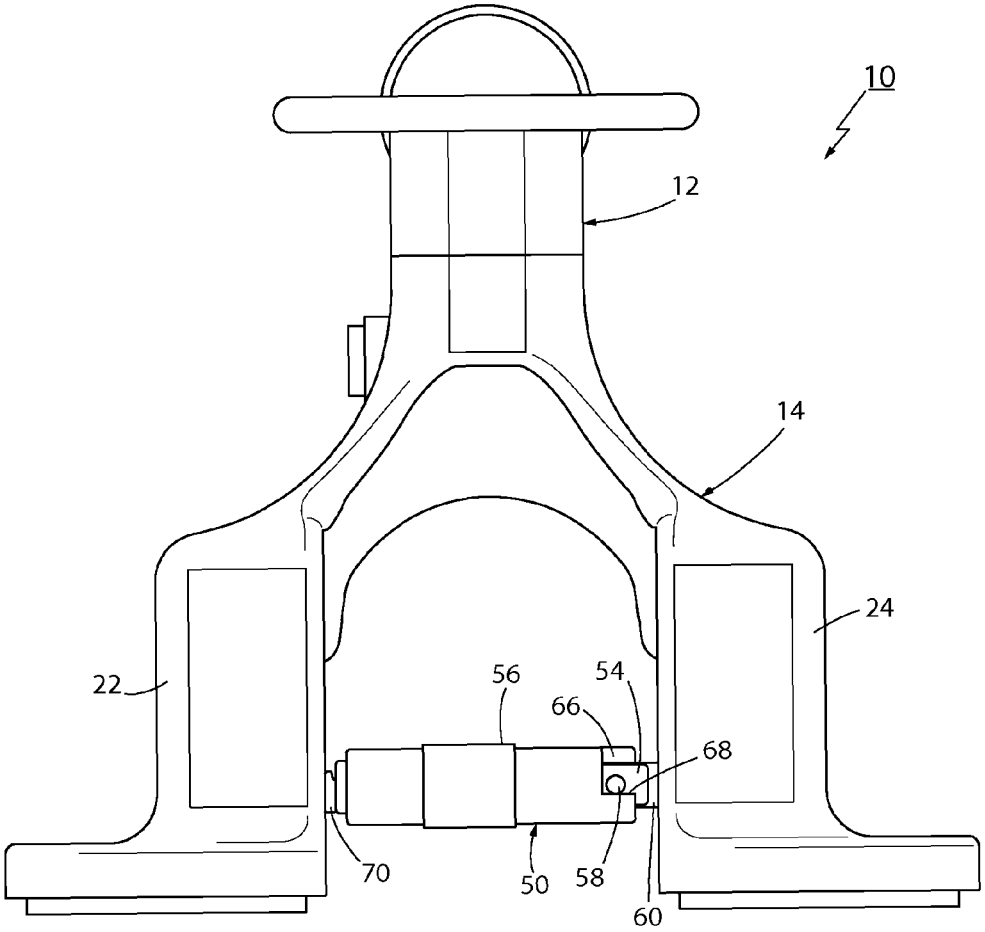
FIG. 5 is an end elevational view similar to FIG. 4, but showing the band impeding member in a closed position.
Figure 6:
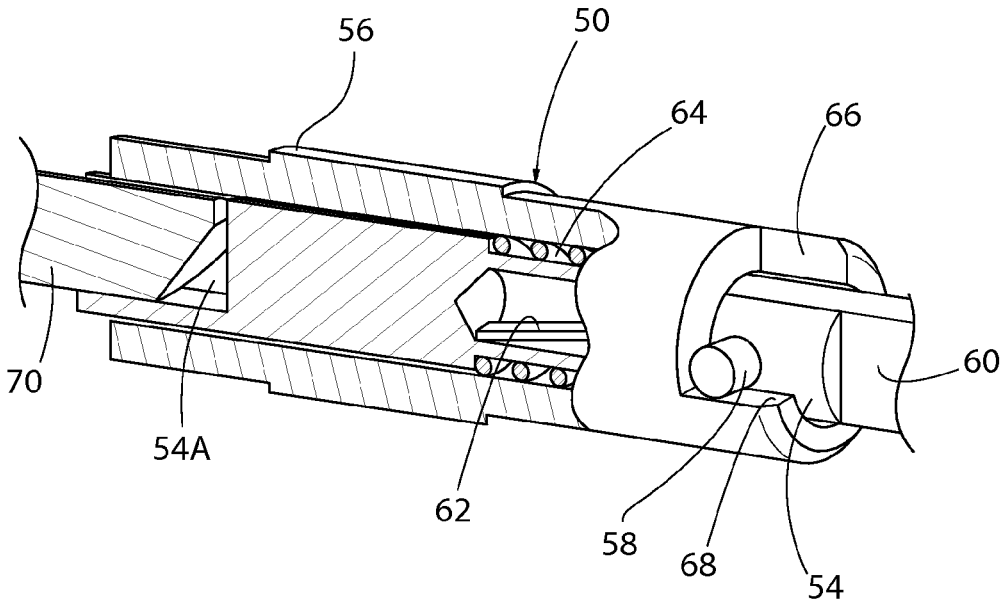
FIG. 6 is a fragmentary isometric view of a portion of the band impeding member showing details of construction.

Referring to FIGS. 4-6, the band impeding member 50 includes an inner rod member 54 surrounded by a rotatable locking sleeve 56 for locking the band impeding member in the closed position illustrated in FIG. 5. The manner in which the rotatable locking sleeve 56 functions to provide this retainer function will be described in detail later in this application.

Still referring to FIGS. 4-6, a pivot pin 58 rotatably supports the inner rod member 54 on a transversely extending, pivot support member 60 that is attached to leg 24 of the body section 14. The support member 60 can be integrally molded with the body section or can be a separate piece attached to the body section by any suitable fastening means.

Referring to FIG. 6, a leaf spring 62 has one of its ends fixed within the interior of the inner rod 54, preferably to the longitudinal pin supporting member 60 by any conventional means (not shown). The opposed end of the leaf spring 62 normally is biased downwardly to thereby normally bias the band impeding member 50 into the open position illustrated in FIG. 4.

Still referring to FIG. 6, it should be noted that a torsion spring 64 is retained in a region between the inner rod 54 and the rotatable locking sleeve 56, with opposed ends of the torsion spring being attached, respectively to each of the members. This torsion spring normally biases the locking sleeve in a rotational direction to close off a slotted opening 54A in inner rod 54 to thereby maintain the band impeding member 50 in a closed position as will be discussed hereinafter.

As can be seen best in FIGS. 4 and 6, a locking projection 70 extends inwardly from leg 22 opposed to the longitudinal pivot support member 60. The locking projection 70 is adapted to insert into the slotted opening 54A in the inner rod member 54 when the outer sleeve is biased into an open position as is illustrated in FIG. 4.

As can be seen best in FIG. 6, the outer rotatable locking sleeve 56 includes an inwardly directed recess defining rotation-limiting surfaces 66, 68 that cooperate with pivot pin 58 to limit the rotational movement of the locking sleeve 56 relative to the inner rod member 50 between an open position permitting the locking projection 70 to enter and exit from slotted opening 54A in the inner rod member 54, and a closed position in which the slotted opening 54A is closed to retain the locking projection 70 within the slotted opening to thereby retain the band impeding member 50 in the closed position shown in FIG. 5. It should be noted that the pivot pin 58 extends through the inner rod member 54 and the longitudinal pivot support member 60 and includes an extending section that is adapted to cooperate with the rotation-limiting surfaces 66, 68.

FIGS. 5 and 6 illustrate the rotational position of the rotatable locking sleeve 56 relative to the inner rod member 54 to close off the slotted opening 54A in the inner rod member and thereby trap the locking projection 70 within the inner rod member to maintain the band impeding member 50 in a closed position. In this position the pivot pin 58 engages rotation-limiting surface 66.

Referring to FIG. 4, in order to permit the band impeding member to move into its normally biased, open position the outer rotational sleeve 56 is rotated manually to a position wherein rotation-limiting surface 66 engages the pivot pin 58 and an open recess in the opposed end of the sleeve (not shown) aligns with the slotted opening 54A to permit the locking projection 70 to move out of its engagement with the slotted opening and thereby move to its downward, open position.

In the open position of the band impeding member 50 illustrated in FIG. 4, the rotation-limiting surface 68 engages the longitudinal pivot support 60 to prevent the rotatable locking sleeve 56 from rotating into its normally biased, closed position illustrated in FIG. 5. It is only after the band impeding member 50 is manually rotated upwardly from its position shown in FIG. 4 to the position shown in FIG. 5, that the outer sleeve 56 is free to rotate into its normally biased position to cause a non-recessed section of the locking sleeve 56 to overlay the slotted opening 54A in the inner rod member 54 and thereby trap the locking projection 70 in said opening.

Figure 7:
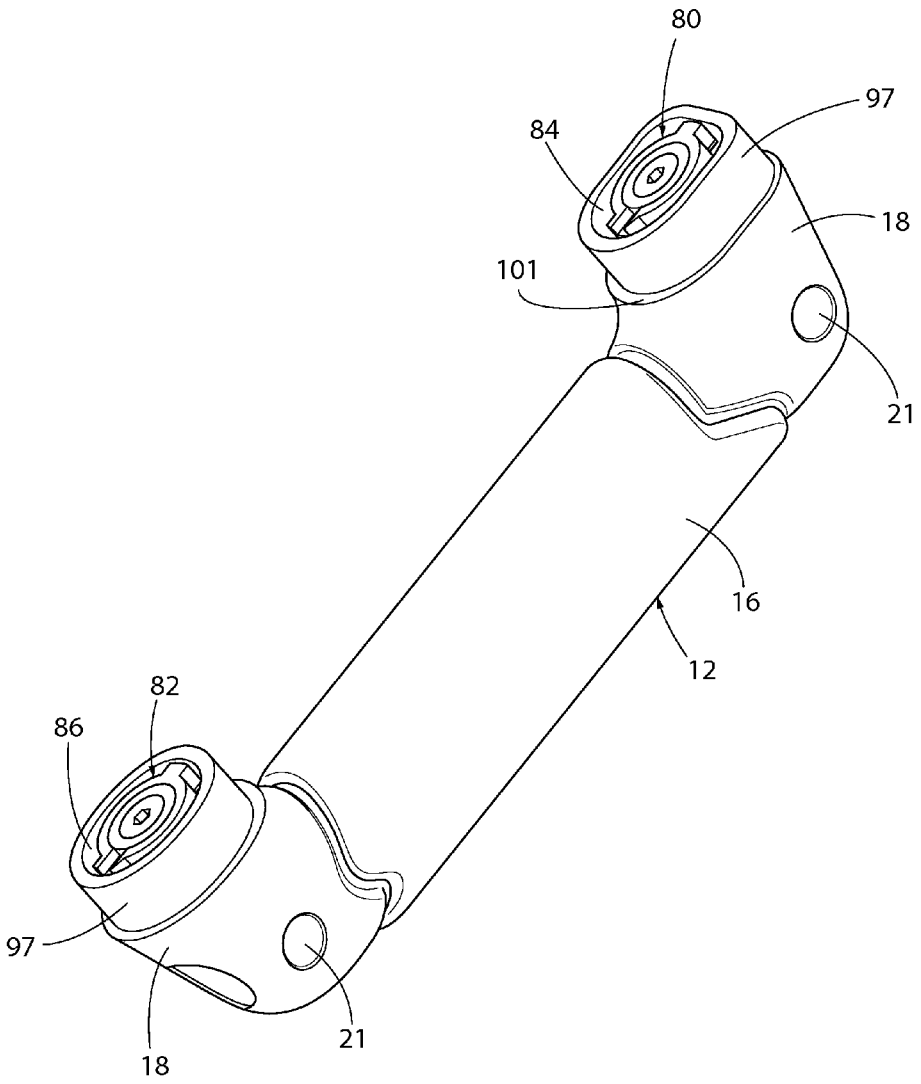
FIG. 7 is an isometric view of the handle section of the pushup device showing features of the connection member for releasably connecting the handle section to the body section of the device.
Figure 8:
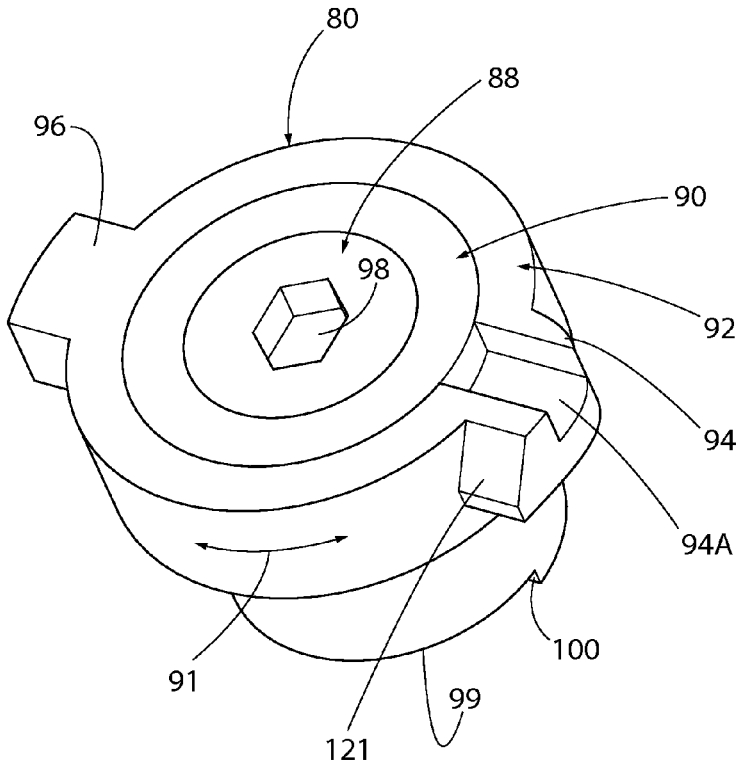
FIG. 8 is an enlarged isometric view showing a portion of the latching member retained in the handle section as illustrated in FIG. 7 for releasably retaining the handle section to the body section of the pushup device.
Figure 9:
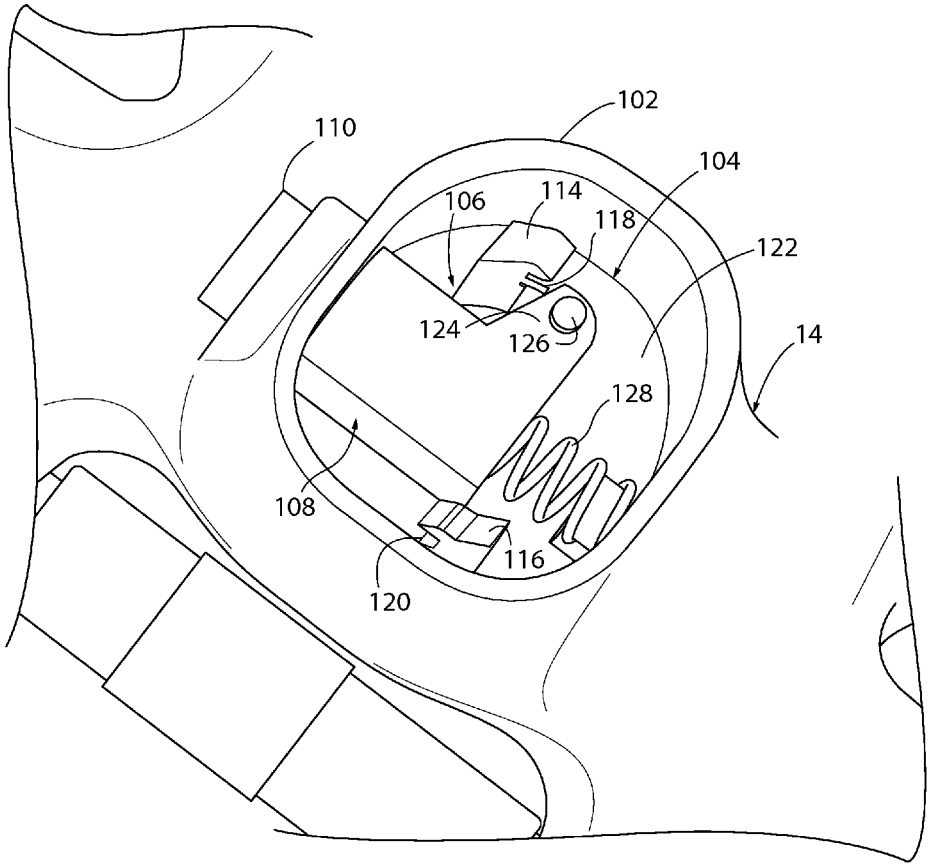
FIG. 9 is a fragmentary plan view illustrating a cooperating latching member included on the body section of the pushup device for cooperating with the attachment member illustrated in FIG. 8 to removably attach the handle section to the body section.
Figure 16:
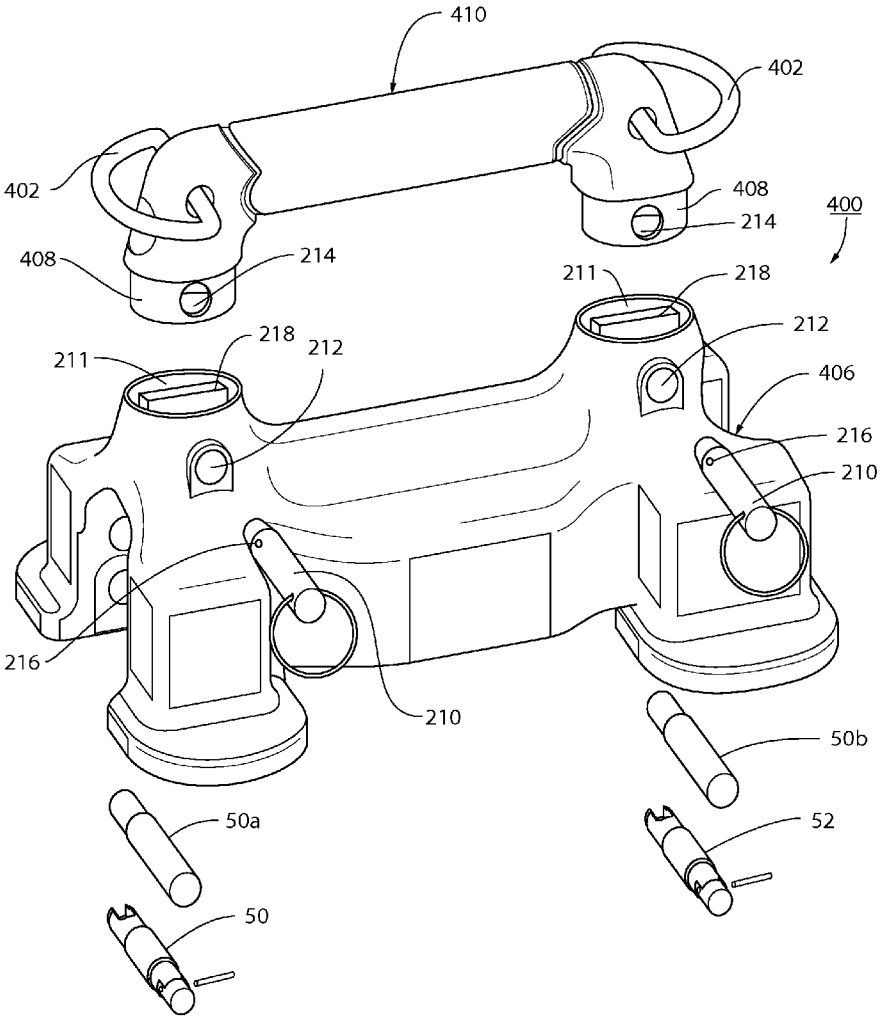
FIG. 16 is an exploded isometric view of a modified pushup device in accordance with this invention employing a preferred and simplified connection member between the handle section and the body section.
Figure 17:
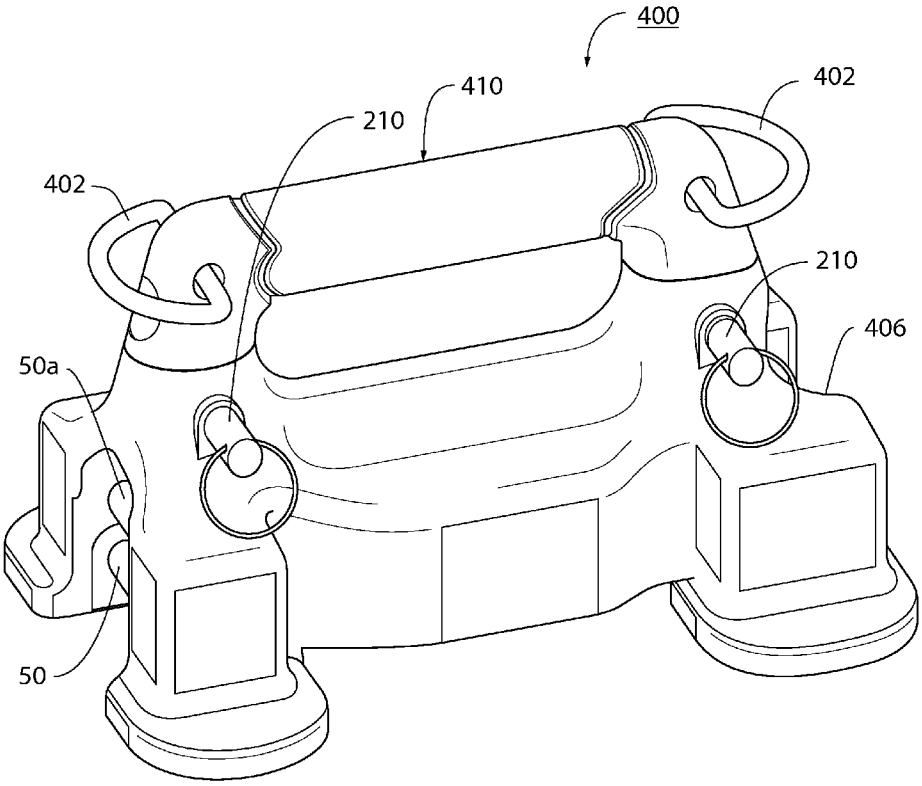
FIG. 17 is an isometric view of the modified pushup device shown in FIG. 15, but with the various components assembled.

Referring to FIGS. 7-9, a preferred arrangement for removably connecting handle section 12 to body section 14 is illustrated. It should be understood that the specific mechanism for removably connecting the handle section to the body section does not constitute a limitation on the broadest aspects of this invention. For example, if desired a spring loaded pin arrangement could be employed to removably attach the handle section to the body section, wherein an outward pulling of a pin would release the pin from an opening in the handle section to permit its removal from the body section. Such an arrangement is illustrated in a preferred embodiment of a pushup device 400 shown in FIGS. 16 and 17, wherein locking pins 210 are inserted in aligned openings 212, 214 in a body section 406 of the device 400 and leg sections 408 of a handle section 410 to retain the handle section attached to the body section. When it is desired to remove the handle section 410 from the body section 406 the pins 210 can be simply pulled out of cooperative engagement with the handle section and body section. The locking pins 210 can be of a conventional design including a spring loaded nib 216 that normally is biased outwardly and is compressed as it passes through a passage (not shown) in a respective locking member 218 formed within the openings 211 of the body section 14. When the spring loaded nib 216 clears the locking member 218 it expands outwardly to retain the handle section 410 attached to the body section 406. As stated above, when it is desired to remove the handle section 410 from the body section 406 the pins 210 can be pulled outward; causing the nibs 216 to retract and pass through the openings in the locking members 218. The locking pins 210 usable in this invention can be of a conventional design, e.g., of the type commonly used in a variety of exercise devices that employ weight stacks in which a number of weights in the stack are captured by such a locking pin.

Figure 18:
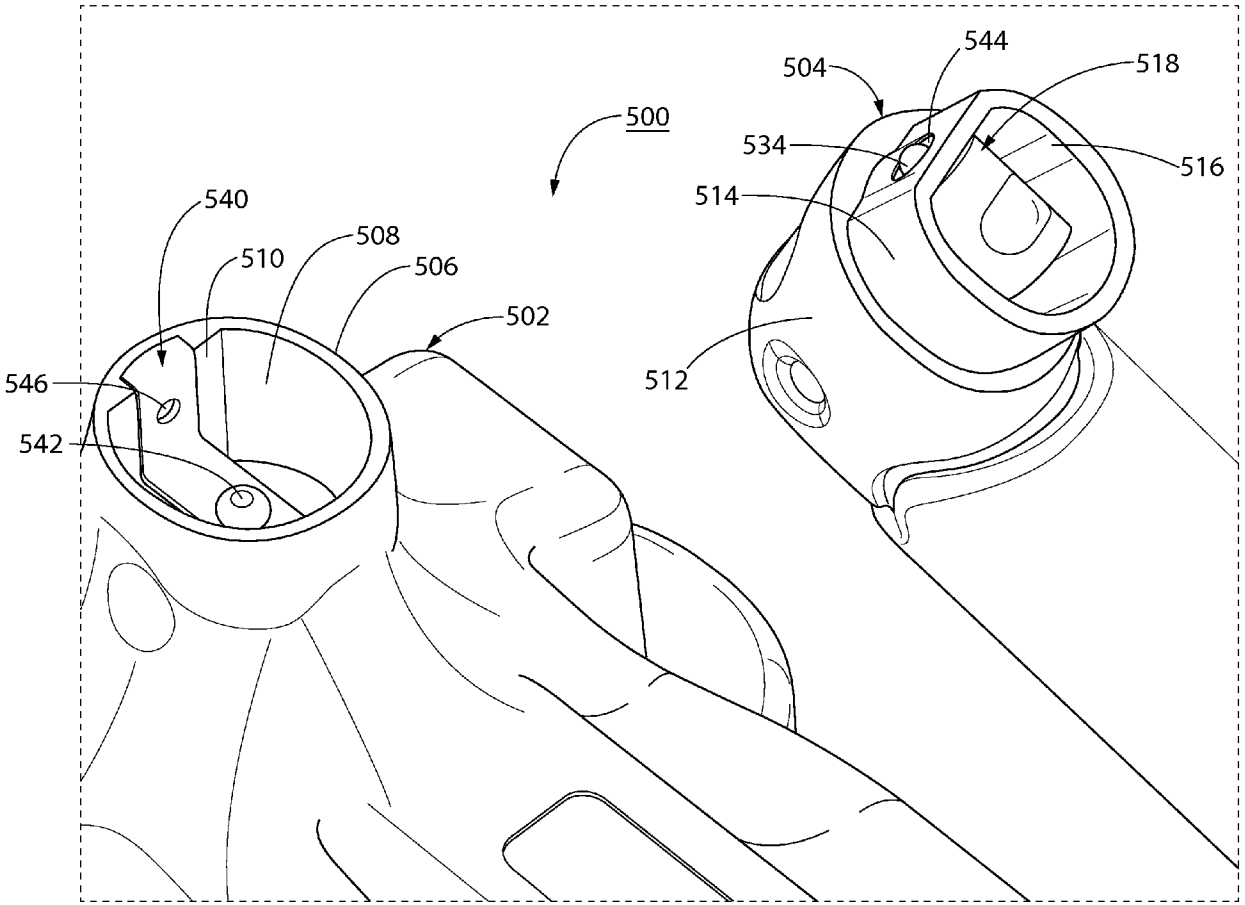
FIG. 18 is a fragmentary isometric view of a modified pushup device with the handle section separated from the body section.
Figure 19:
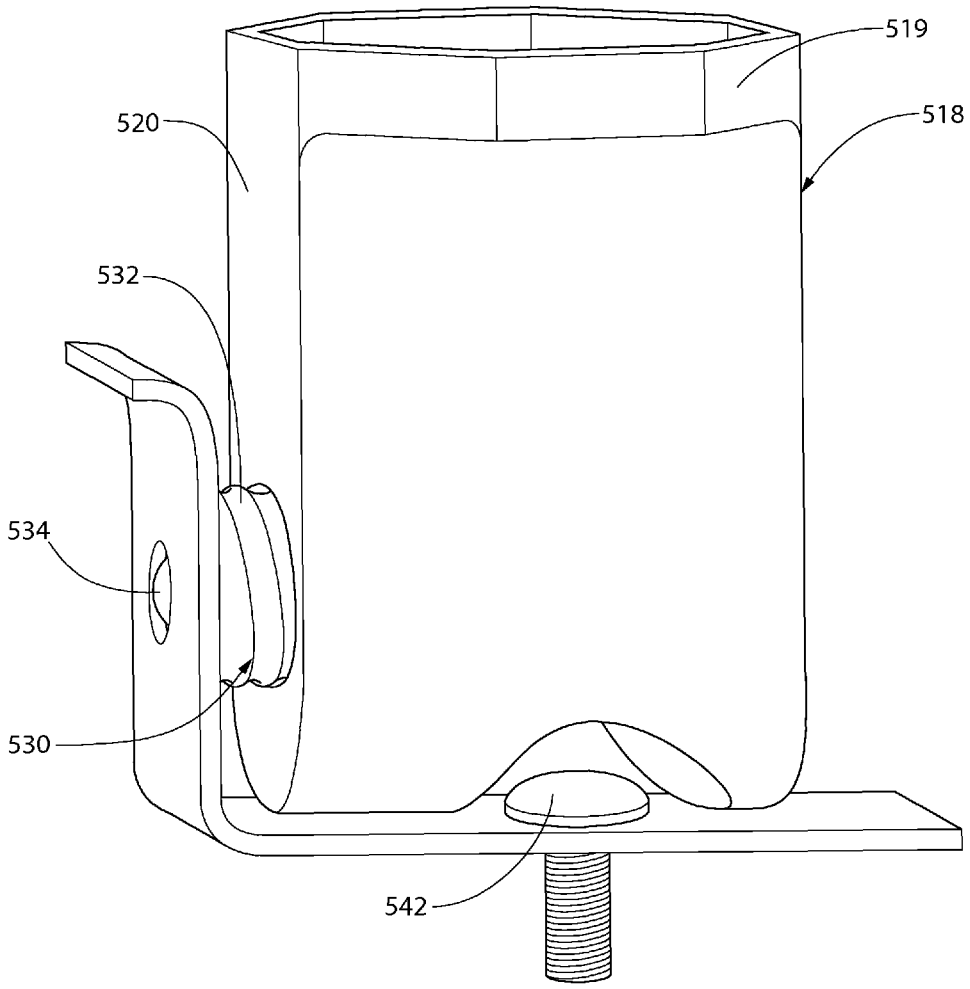
FIG. 19 is an isometric view of a portion of the locking system between the handle section and the body section of the pushup device shown in FIG. 18.

Referring to FIGS. 18 and 19 a push-up device 500 includes an additional arrangement for removably connecting a body section 502 to a handle section 504 thereof.

Specifically, the body section 502, similar to the other embodiments of this invention, includes opposed, identical upstanding hubs, only one of which is shown at 506. Each hub 506 includes a non-round compartment 508 including flat surface 510 forming a part thereof. It should be understood that other non-round configurations can be employed in accordance with this invention; the specific shape not constituting a limitation on the broadest aspects of this invention. The handle section 504 includes opposed, identical leg sections, only one being shown at 512 in FIG. 18.

As can be seen in FIG. 18, each leg section 512 includes a peripheral hub section 514 having a non-round peripheral configuration complementary in shape to the non-round configuration of the compartment 508 in the upstanding hub section 506 of the body section 502 to be telescopically received therein. A non-round opening 516 is included in the hub section 514 and includes a recessed base (not visible) into which a metal mounting member 518 is inserted.

As can be seen best in FIG. 19, the metal mounting member 518 includes a upper section 519, which is illustrated as being octagonal in shape, and a corresponding octagonal-shaped opening (not shown) is provided in the base of opening 516 so that the mounting member 518 is mounted against rotation relative to the leg section 512.

As can be seen best in FIG. 19 the metal mounting member 518 includes a sidewall 520 having an internally threaded passage (not shown) for receiving an externally threaded plunger device 530. The plunger device 530 can be a conventional, off-the-shelf product identified as a spring plunger. The spring plunger device 530 includes a compression spring (not shown) within housing 532 thereof for biasing locking member 534 of the device 530 in an outward direction.

Referring again to FIG. 18, a generally L-shaped locking bracket 540 is inserted within the compartment 508 in the hub 506, and is screwed into the base of the compartment with a conventional fastening member, such as a screw 542.

As can be seen best in FIG. 19, the lower section of the metal mounting member 518 is recessed to receive the head of the mounting screw 542 when the handle section 504 is attached to the body section 502.

As can be seen best in FIG. 18, the metal mounting member 518 with the spring plunger device 530 secured thereto is mounted in the compartment 516 of the hub 514 with the locking member 534 thereof passing through a complementary passage 544 in a flat sidewall of the hub 514. The positioning of the locking member 534 within the passage 544 in the sidewall of the hub 506 prevents the metal mounting member 518 with the plunger device 530 attached thereto from disengaging from the handle section 504. Moreover, due to the cooperation of the non-round upper section 519 (FIG. 19) of the metal mounting section 518 with a corresponding non-round opening in the base of hub section 514 the metal mounting member 518 and the spring plunger device 530 attached thereto are prevented from rotating within the hub section.

From the above discussion the manner in which the handle section 504 is removably attached to the body section 502 should be readily apparent. Specifically, when the handle section 504 is being attached to the body section the hub section 514 of the handle section is inserted into the correspondingly-shaped compartment 508 in the upstanding hub section 506 of the body section 502. During the initial insertion operation the locking member 534 will be biased inwardly against the generally L-shaped locking bracket 540 until the locking member 534 aligns with passage 546 in the locking member. At that time the locking member will be biased outwardly into the passage 546 of the locking bracket 540 to thereby retain the handle section 504 connected to the body section 502.

In order to disassemble or separate the handle section 504 from the body section 502 an individual can pull outwardly on the handle section while engaging the body section to prevent it from moving with the handle section. When an upward force of a predetermined level is reached the locking member 534 will be forced inwardly to release from passage 546 of the locking bracket 540 and permit the handle section 504 to be separated from the body section 502.

Moreover, a variety of other removable attaching members could be employed in accordance with the broadest aspects of this invention; including a simple screw arrangement.

Referring to FIG. 7, locking elements 80, 82 are secured within spaced-apart recessed compartments 84, 86 in the leg sections 18.

Referring to FIG. 8, the general construction of the locking element 80 will be described, it being understood that the locking element 82 is of identical construction and is fastened within its corresponding compartment 86 in the same manner as the locking element 80 is fastened with compartment 84. As can be seen in FIG. 8, the locking element 80 is a multi-component structure including an inner member 88, an annular bearing member 90 and an outer, rotatable locking member 92 that is rotatable about the annular bearing member 90.

It should be noted that the inner member 88 and annular bearing member 90 are connected together and are not rotatable. The outer locking member 92 is rotatable relative to the inner member 88 and annular bearing member 90 as shown by double-headed arrow 91 to provide its desired locking and release functions as will be described in detail hereinafter.

As can be seen in FIG. 8, the outer rotatable locking member 92 includes diametrically opposed tabs 94, 96 with the tab 94 including a radially extending recess 94A therein. These diametrically opposed tabs 94, 96 cooperate with corresponding locking members provided in the body section to releasably lock the handle section to the body section as will be described in greater detail hereinafter.

Still referring to FIGS. 8, the inner member 88 is provided with a passage 98 for receiving an Allen bolt or screw that connects the locking element 80 to the base of the compartment 84 and thereby prevents its inadvertent removal from that compartment.

Referring to FIG. 8, it should be noted that the lower surface 99 of the annular bearing member 90 and, if desired, inner member 88 is (are) provided with a step configuration providing a downwardly extending surface 100 that cooperates with a corresponding upwardly extending surface (not shown) in the base of the recessed compartment 84 to thereby assure that the locking element 80 is inserted and secured in a proper position within the recessed compartment 84 to provide its required connecting function.

As can be seen in FIG. 7, the outer wall 97 of the handle section that defines the compartment 84 is inwardly offset relative to the remaining portion of the handle section to provide a downwardly facing shoulder 101 that cooperates with peripheral wall 102 (FIG. 9) of the body section 14 to maintain the handle section 12 connected to the body section, when desired.

Referring to FIG. 9, the body section 14 includes the upper peripheral wall 102 that defines a cup-shaped opening or compartment 104 that receives a locking system 106 that cooperates with the locking element 80 to provide the desired releasable locking function. It should be understood that the locking system that cooperates with the locking element 82 is identical in construction, and therefore the description which follows will be limited solely to the arrangement and operation of the locking system 106 that cooperates with locking element 80.

Referring specifically to FIG. 9, an actuating member 108 is of a generally L-shaped construction and includes a leg segment 110 extending through the peripheral wall 102 and constituting an actuating button for operating the actuating member 108 to release the connection between the handle section 12 and the body section 14, when desired.

Still referring to FIG. 9, the cooperating locking system 106 includes spaced-apart locking members 114, 116, each including undercut regions 118, 120 therein for receiving the tabs 94, 96 therein when the handle section 12 is connected to the body section 14. In a preferred arrangement the locking members 114, 116 are integrally molded as part of the lower surface 122 of the compartment 104. However, in accordance with the broadest aspects of this invention other arrangements can be provided for attaching locking members 114, 116 to the lower surface 122 of the compartment 104.

As can be seen in FIG. 9, a base segment of the actuating member 108 includes a raised nub 126 extending upwardly therefrom, and the actuating member 108 is normally biased into the position illustrated in FIG. 9 by compression spring 128.

The manner in which locking element 80 located in the handle section 12 releasably cooperates with the locking system 106 retained in the body section will be described in connection with FIGS. 9A-9D.

Figure 9A:
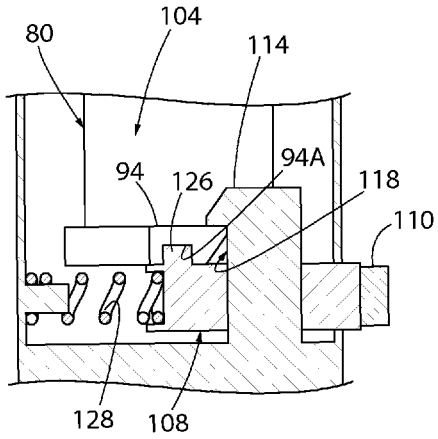
FIGS. 9A-9D show sequential steps in the actuation of the cooperating retainer members of the handle and body section for detaching the handle section from the body section.

Referring to FIG. 9A, the arrangement of elements is illustrated in the position occupied by them when the handle section 12 is retained to the body section 14. Specifically, in this position the actuating member 108 is biased outwardly by compression spring 128 so as to position the push button extension 110 thereof in an easily engageable position by a person desiring to separate the handle section from the body section. In this orientation the raised nub 126 is retained within the elongate slot 94A in the tab 94 with the tab 94 extending into the undercut region 118 of locking member 114. In this orientation the other tab 96 provided on the rotatable locking member 92 is positioned within the undercut region 120 of locking member 116 (not shown).

Figure 9B:
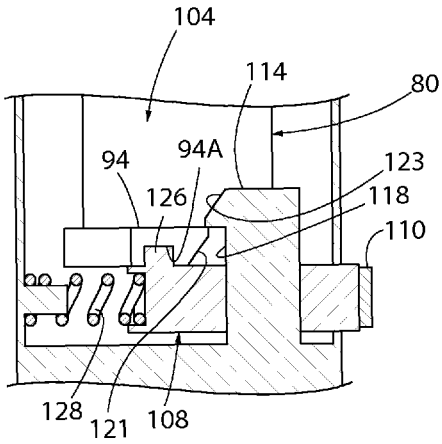
Figure 9C:
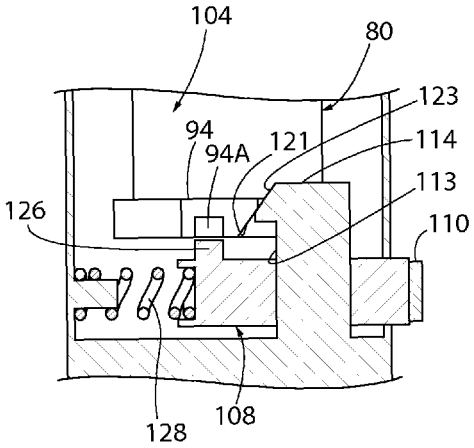
Figure 9D:
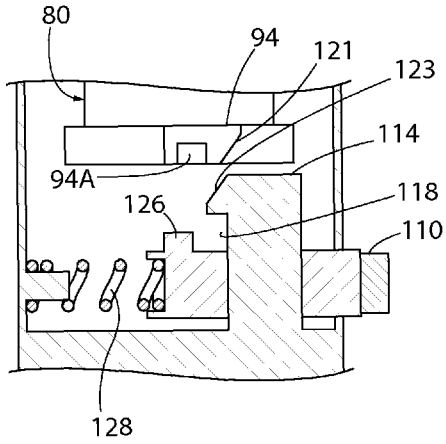

Referring to FIGS. 9B and 9C, when it is desired to separate the handle section 12 from the body section 14 the extension 110 of the L-shaped actuating member 108 is pushed inwardly to thereby cause the nub 126 to interact with the sidewalls of the elongate slot 94A in the tab 94 to rotate the locking member 92 in a clockwise direction as illustrated in FIGS. 8 and 9, to thereby release the diametrically opposed tabs 94, 96 from their underlying relationship with the undercut regions 118, 120 in locking members 114, 116, respectively. The full release of the opposed tabs 94, 96 from the undercut regions 118, 120 is illustrated in FIG. 9C, in which location cooperating inclined surfaces 121, 123 provided on the locking tab 94 and locking member 114, respectively, slide on each other during removal of the handle section 12 from the body section 14. The fully separated position of the handle section 12 with respect to the body section 14 is illustrated in FIG. 9D.

Establishing the connection between the handle section 12 and the body section 14 is achieved by simply reversing the procedure employed to separate the handle section from the body section. That is, as the handle section 12 is pressed downwardly to position the outer wall 97 thereof into the cup shaped compartment 104 provided by the peripheral wall 102 the inclined surfaces 121, 123 on the locking tab 94 and locking member 114, respectively, cooperate by sliding against each other to cause the elongate slot 94A in the locking tab 94 of the outer rotatable locking member 92 to rotate into a position engaging the raised nub 126, whereby the spring bias imposed by compression spring 128 on the actuating member 108 rotates the locking tab 94 into the undercut region 118 and the diametrically opposed locking tab into the undercut region 120. This arrangement automatically locks the handle section 12 to the body section 14.

Although the above described releasable locking construction can be used in the pushup device 10 to provide a removable connection of the handle section 12 to the body section 14, it is again emphasized that the present invention is not limited to the use of any specific releasable attachment member between the handle section and body section, as was discussed previously in this application. In fact, the attachment arrangement discussed earlier in connection with FIGS. 16 and 17 is preferred because of its simplicity of construction.

Referring to FIG. 10, which was discussed previously in this application, the use of a pair of pushup devices 10 in conjunction with an elastic exercise band 40 in accordance with a preferred method of this invention is illustrated. As noted above, the exercise band 40 is attached to one of the retainers 20 of each pushup device 10; is positioned through passage 34 of each pushup device and is directed over the back of an individual carrying out a pushup exercise. It should be clear that when the user extends his or her arms, pushing up on the pushup devices 10 the elastic band 40 is caused to stretch, thereby providing a downward force opposing the upward force imposed by the user pushing up from the pushup devices 10. This provides additional resistance in a pushup exercise to enhance the effectiveness of the exercise.

As explained above, by providing longitudinal passages 34 through the pushup devices 10 at least two advantages are achieved. First, an exercise band of a standard length that normally is employed to do a variety of other exercises can be used, with excessive length being taken up within the confines of the passages 34. Thus, separate, shorter exercise bands do not need to be provided for use in conjunction with the pushup devices 10; thereby limiting the inventory that an establishment/individual needs to retain to do pushups and other exercises employing elastic bands. Secondly, by positioning the exercise band through the passageways 34 in the pushup devices 10, the force imposed upon the exercise band 40 during the pushup is transmitted over the longitudinal extent of the pushup devices, thereby providing a more even distribution of force along the pushup device than otherwise would be provided if the exercise bands were not positioned through the passages 34.

It also should be noted that although the pushup devices 10 illustrated in FIG. 10 are oriented with the elongate longitudinal dimension generally parallel to the length of the individual carrying out a pushup, it is within the scope of this invention to carry out the method of this invention with the pushup devices retained in any desired orientation relative to the user's body. For example, each of the pushup devices 10 can be oriented 90° from the position illustrated in FIG. 10. In this latter position the elongate longitudinal dimension of the pushup devices will be oriented perpendicular to the length of the individual carrying out a pushup.

Although FIG. 10 illustrates providing a pushup exercise with a single elastic exercise band 40 it should be understood that the construction and arrangement of elements in the pushup devices permits multiple exercise bands to be attached to the D rings so that the amount of resistant force imposed upon a person doing pushups can be varied.

Figure 11:
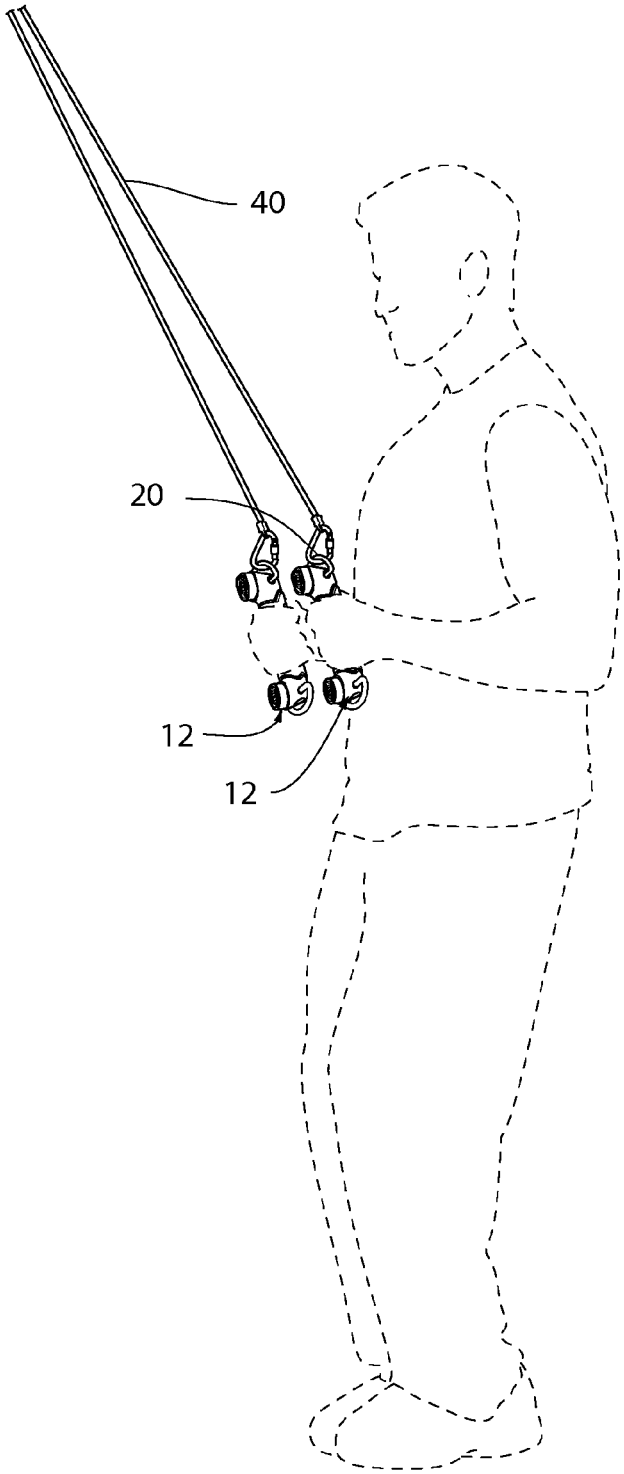
FIG. 11 is a schematic view illustrating an arrangement in which handle sections of the pushup devices can be used separately from the body section in connection with one or more elastic exercise bands for providing exercises other than pushups.

Referring to FIG. 11, an exemplary view illustrates a representative manner in which the handle sections 12 of the pushup devices can be employed with an exercise band 40 separate from the body section of the pushup devices to carry out a variety of different exercises other than pushups, In other words, as shown in FIG. 11, the handle sections 12 actually function as handle extensions of one or more exercise bands that can be used for a variety of different exercises, such as a tricep pushdowns, etc. Thus, the handle sections 12 of the pushup devices can be used in place of other conventional handle sections employed with exercise bands to provide a variety of different exercises.

Figure 12:
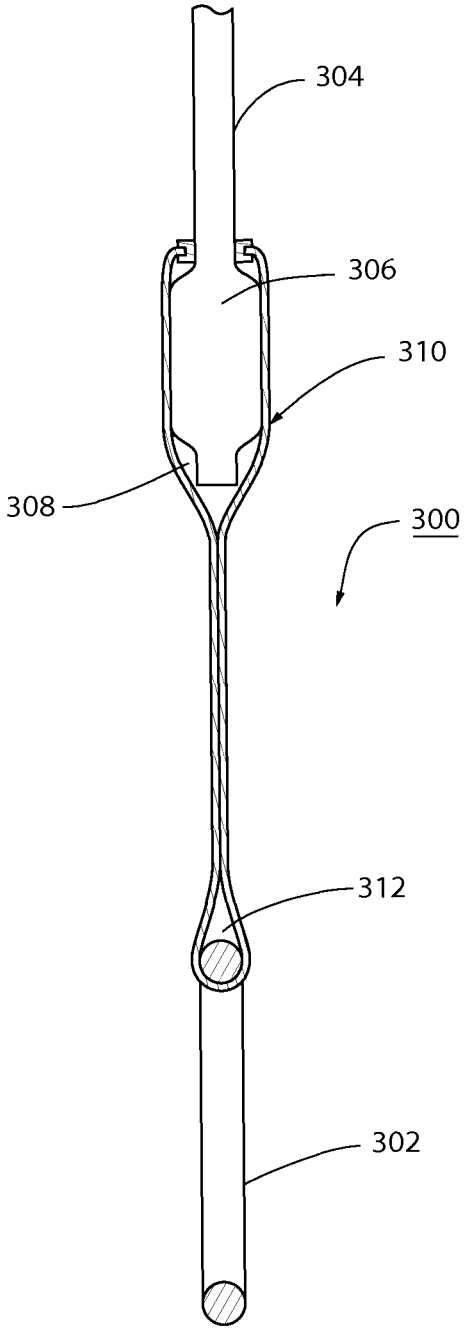
FIG. 12 is a fragmentary end elevation view of one end of a conventional elastic exercise band usable with the all of the embodiments of this invention, showing somewhat schematically a connection member between the band and carabineer; the opposed end of the exercise band being provided with an identical connection member for a carabineer.

It should be noted that for some exercises it may be desirable to use only a single handle section with opposed ends of an exercise band connected to the longitudinally spaced apart retainers, (e.g., D rings) of the handle section. In other exercises it may be desirable to retain separate elastic bands on opposed D rings of a single handle section to provide a desired exercise Referring to FIG. 12, a fragmentary end elevational view shows a conventional connection member 300 for attaching a carabineer 302 to an elastic exercise band 304. It is understood that the opposed carabineer at the opposite end (not shown) is attached to the elastic band 304 through a connection member identical to that illustrated at 300 in FIG. 12. Such representative connection members are shown in assignees U.S. Pat. Nos. 7,819,787 and 7,785,243, the subject matter of which is fully incorporated by reference herein. As is somewhat schematically illustrated in FIG. 12, one representative connection includes a plug (not shown) that has a substantially larger diameter than the band such that its insertion into a distal end of the elastic band 304 provides an enlarged section 306 that is retained within a passageway 308 of a connecting tether 310. The tether is stitched to provide the passageway 308 and also a spaced-apart passageway 312 to which carabineer 302 is attached. It should be apparent that a space exists between the carabineer 302 and the elastic band 304; resulting in a long span of the elastic band 304 available to extend over the back of an individual providing a pushup. In some cases, depending upon the size of the individual, this span is too great and needs to be shortened. To provide this ability to shorten the span an improved structure of a pushup device is illustrated at 400 in FIGS. 13-15. As will be explained in greater detail hereinafter the improved pushup device 400 includes a unique retainer 401 for engaging the tether including the enlarged section 306 of the band therein to retain the band in proper position relative to the pushup device when a person is doing a pushup exercise with a central section of the band positioned over the person's back.

Figure 13:
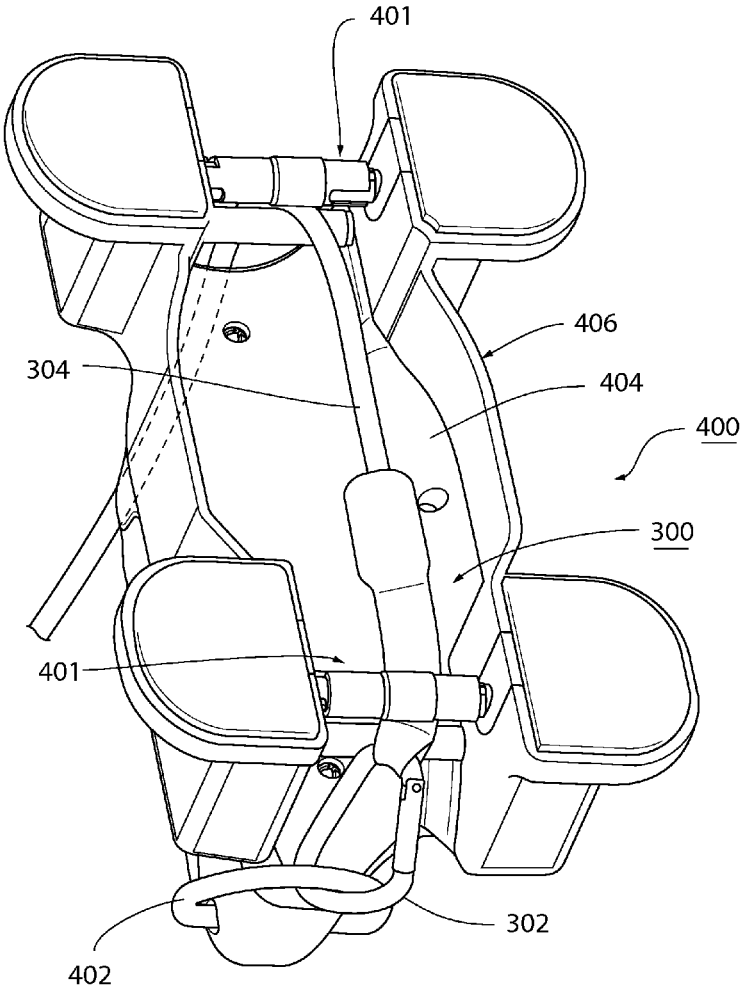
FIG. 13 is an isometric view of an improved embodiment of a pushup device, viewed from the lower surface of the pushup device similar to the view of the first embodiment of this invention shown in FIG. 3, illustrating the elastic band of FIG. 12 attached to a carabineer.

Referring to FIG. 13, the improved pushup device 400 is illustrated, but with the elastic band 304 employing the connection member 300 shown in FIG. 13 being connected by carabineer 302 to one of the D-rings 402 in the same manner as illustrated in connection with the earlier disclosed embodiment of this invention. As can be seen in this FIG. 13, the enlarged connection member 300 is disposed in a region in underlying engagement with lower surface 404 of the body section 406 of the pushup device. As stated above, this may result in an excessively long span of the elastic band 304 overlying an individual's back when the individual is engaged in an a pushup exercise. Specifically, if the span is too long the band will not be placed under desired tension during a pushup; rather, during the initial portion of the pushup (or possibly during the entire portion) slack will be taken out of the band 304 without imposing a downward force against the user.

Figure 14:
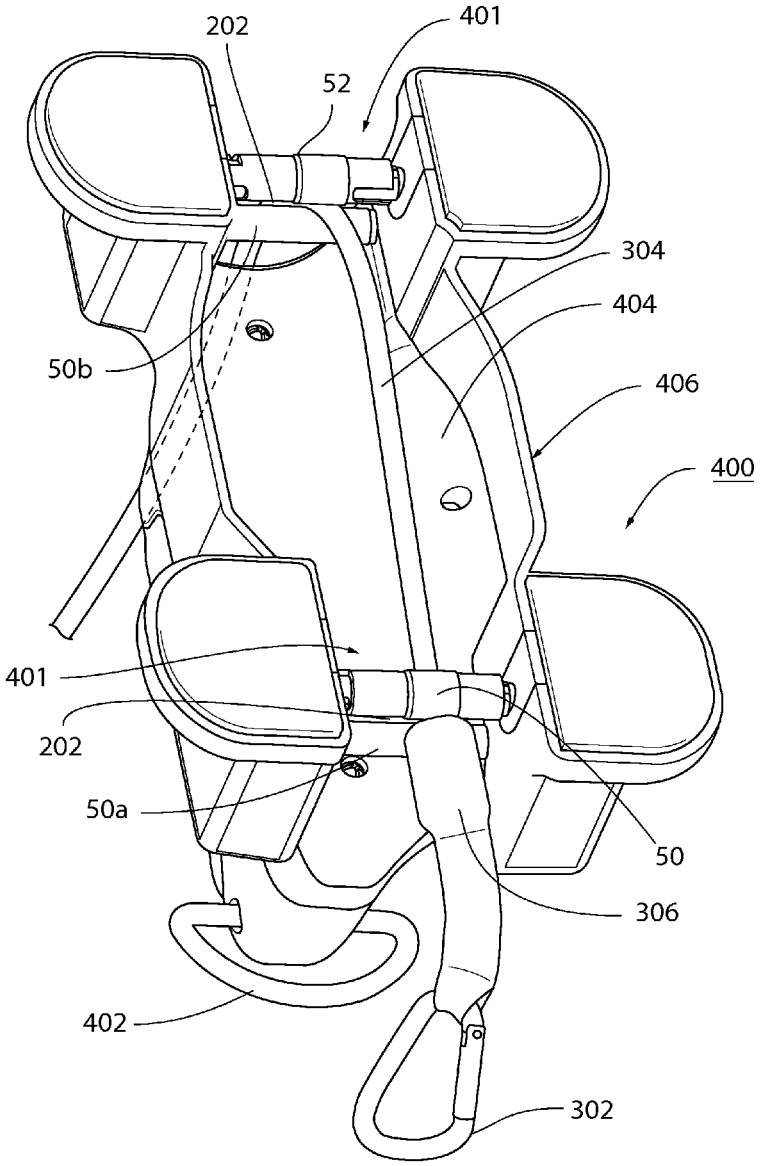
FIG. 14 is an isometric view of the improved embodiment of a pushup device, viewed from the lower surface of the pushup device similar to the view of the first embodiment of this invention shown in FIG. 3, illustrating the elastic band of FIG. 12 attached to the pushup device through a retainer system that does not include the carabineer.
Figure 15:
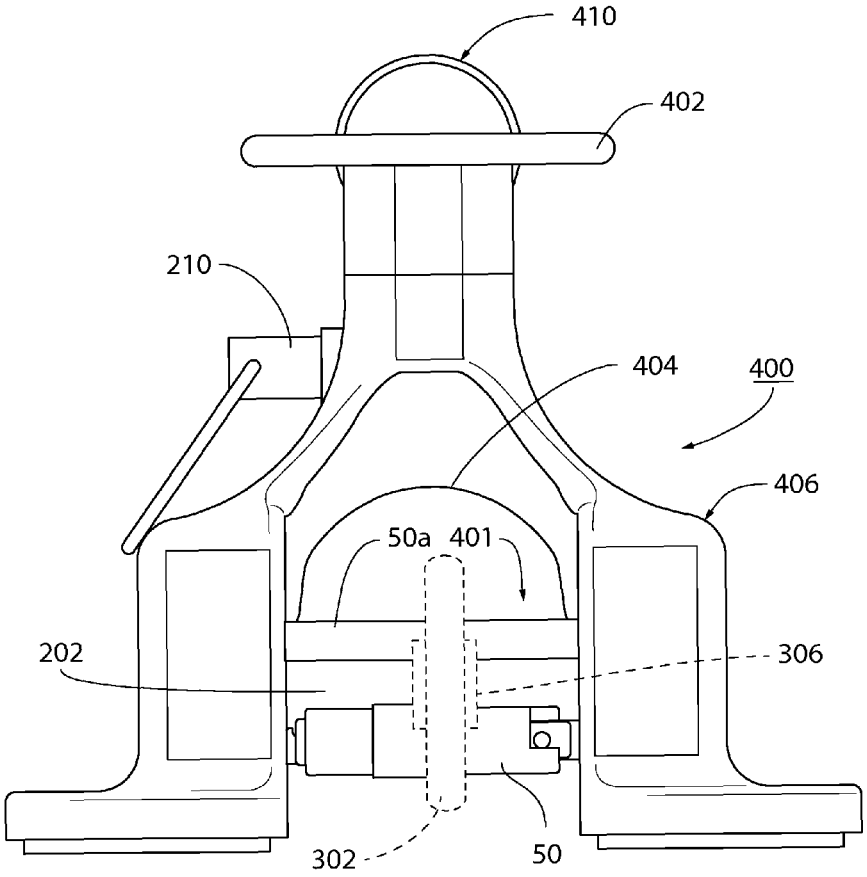
FIG. 15 is an end elevational view of the improved pushup device shown in FIG. 14, similar to the view of the first embodiment of this invention shown in FIG. 5, illustrating the alternative arrangement for retaining the elastic band of FIG. 12 attached to the pushup device without employing the carabineer, as is shown in FIG. 14.

Referring to FIG. 14, an isometric view from the lower surface of the improved pushup device 400 is shown, with the exercise band 304 being connected to the pushup device for straddling a user's back through an improved arrangement that does not employ the D-rings 402. This view is similar to the view of the pushup device shown in FIG. 3 and is the same as the view illustrated in FIG. 13. As noted above in connection with the discussion of FIG. 13, the improved pushup device 400 can be used in exactly the same manner is the earlier described embodiments, with the carabineer attached to the D-ring.

However, as will be explained in detail hereinafter, the improved pushup device 400 differs from the originally disclosed embodiment by including a pair of band guiding members 50*a*, 50*b* spaced, respectively from and cooperating with the band impeding members 50 and 52, to provide a pair of spaced-apart retainers 401; each retainer including a narrow band receiving passages 202 (See FIGS. 14 and 15) that has a sufficient space to permit the elastic exercise band 304 to pass freely therethrough but precludes passage of the enlarged band connection member 300 therethrough. Thus the retainers provided by the cooperating guiding members 50*a*, 50*b* and impeding members 50, 52, aid in retaining or holding the exercise band attached to the respective pushup devices 400, to permit the span of the exercise band 304 positioned over the user's back to be adjusted when necessary to provide a desired downward force or pressure on an individual's back when the individual is engaged in a pushup exercise. As should be apparent from a comparison of the arrangements shown in FIGS. 13 and 14, respectively, the span of the exercise band 304 available to be positioned over a user's back is shortened when the band 304 is attached to the pushup device in the manner shown in FIG. 14 as opposed to when the band 304 is attached to a D-ring of the push up device, as shown in FIG. 13.

The band guiding members 50*a*, 50*b* can be of any desired constructions. They can be members that are directly molded into the structure of the pushup devices 400. If desired they can be provided with threaded openings at the opposed ends and be threadedly connected to the legs of the body section of the pushup device by screws passing through the legs and into the threaded openings. Optionally, each of the band guiding members can include a pair of spring-loaded, telescoping sections. In accordance with the broadest aspects of this invention any type of connection for the band guiding members can be employed, provided the connection does not interfere with the operation of the exercise band(s) passing through passages 202 during a pushup exercise.

Although the illustrated embodiments includes a pair of retainers 401 provided by the cooperation of band guiding members 50*a*, 50*b* with band impeding members 50, 52, respectively, it is within the scope of the invention to provide only a single retainer located at the rear end of a pushup device during use. This actually may be most desirably since only one retainer functions to provide the desired engagement with the exercise band being employed with the pushup device. This also may be necessary to prevent the exercise band from engaging a front edge of the pushup device 400 during a pushup operation and apply an undesired upward force to the pushup device.

While the invention has been described in detail and with reference to specific examples thereof, it will be apparent to one skilled in the art that various changes and modifications can be made therein without departing from the spirit and scope thereof.

What is claimed is:

1. A method of doing pushups employing the resistive force of a stretchable elastic exercise band in accordance with this invention, said method including the steps of: (a) employing a pair of pushup devices, each device including a body section having a lower surface for engaging a support surface and an upper handle section attached to said body section for engagement by a person desiring to do pushups; each pushup device further including at least one retainer for engaging a cooperating connection member of a stretchable elastic exercise band; (b) employing one or more stretchable elastic exercise band, each having a connection member at each end thereof, each connection member being engageable with a retainer on each of the pushup devices; (c) engaging the connection member located at one end of the one or more stretchable elastic exercise band with a retainer of one of the pair of pushup devices and engaging the connection member at an opposed end of the one or more stretchable elastic exercise band with a retainer member of the other of said pair of pushup devices, and (d) a person desiring to do pushups engaging the handle section of each of said pair of pushup devices with the pushup devices supported on the support surface on opposite longitudinal sides of the person and with the one or more stretchable elastic exercise band positioned over the person's back area with the connection member at each end of said one or more stretchable elastic exercise bands being engaged with a cooperating retainer on each of the pair of pushup devices, respectively, whereby a person doing pushups experiences a downward resistive force of the one or more elastic exercise bands as the person pushes upwardly on the handle sections of said pushup devices.

2. The method of claim 1, including the steps of attaching a plurality of stretchable elastic bands to the pushup devices through cooperation of the connection members of the bands and the retainers of the pushup device, and carrying out one or more pushups with the plurality of stretchable elastic bands positioned over the back area of a person doing pushups.

3. The method of claim 1 wherein the handle section of each device is removable from its corresponding body section and includes at least one retainer thereon, including the steps of: removing at least one handle section from its cooperating body section;

engaging one or more cooperating connection members of the one or more stretchable elastic bands with said at least one retainer on the handle section removed from its corresponding body section, and gripping the at least one handle section to carry out one or more exercises other than pushups with the one or more stretchable elastic bands and the at least one handle section engaged thereto.

4. The method of claim 1 wherein a pair of retainers are provided in spaced-apart relationship on the handle section of each pushup device and the handle sections are removable from their respective body sections, including the steps of removing at least one handle section from its corresponding body section and engaging said at least one handle section with the one or more elastic exercise bands connected thereto to carry out one or more exercises other than pushups with the one or more stretchable elastic bands and the at least one handle section attached thereto.

5. The method of claim 1, wherein at least one retainer is included on the handle section.

6. The method of claim 1, wherein at least one retainer is included on the body section.

7. The method of claim 1, wherein at least one retainer is included on the handle section and at least one retainer is included on the body section.

8. A pushup device for use with a like pushup device during one or more pushups, said pushup device includes a body section having a lower surface for engaging a support surface and an upper handle section attached to the body section for engagement by a person desiring to do pushups; said handle section further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer, said handle section being removably connected to said body section, whereby the handle section of said pushup device can be separated from its body section and used with one or more elastic exercise bands engaged with a retainer attached to the handle section.

9. The pushup device of claim 8, including a pair of retainers secured respectively at opposed, spaced apart ends of a respective handle section thereof.

10. A pushup device for use with a like pushup device during one or more pushups, said pushup device includes a body section having a lower surface for engaging a support surface and an upper handle section attached to the body section for engagement by a person desiring to do pushups; said device further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer, wherein the body section further includes one or more band-impeding members thereon located above the lower surface of the body section that is adapted to engage the support surface and below the surface segment of the body section defining a passage through the body section.

11. The pushup device of claim 10, wherein the body section includes at least a pair of band-impeding members thereon located above the lower surface of the body section that is adapted to engage the support surface and below the surface segment of the body section defining a passage through the body section, the band-impeding members bridging a longitudinal dimension of said passage and being spaced longitudinally from each other.

12. The pushup device of claim 10, wherein the body section further including one or more band guiding members, said one or more band guiding members being closely spaced to, and cooperating with said one or more band impeding members, wherein each band guiding member and cooperating band impeding member are spaced-apart to provide a passageway there between for receiving a body section of an elastic exercise band therethrough, said passageway being too small to permit a connection member of the exercise band from passing therethrough, each cooperating band impeding member and band guiding member constituting a retainer on the body section of the pushup devices for engaging a connection member of the exercise band located at an end of said exercise band.

13. The pushup device of claim 8, said pushup device including at least one retainer on the body section.

14. The pushup device of claim 8, said pushup device includes at least a pair of retainers on the handle section.

15. The pushup device of claim 8, wherein said pushup device also includes at least one retainer on the body section, said at least one retainer on the handle section being in the form of an attachment ring attached to the handle section to engage and receive a carabineer of an elastic exercise band located at an end of said exercise band, said at least one retainer attached to the body section including a band impeding member and a cooperating guide member, said band impeding member and cooperating guide member being attached to the body section in a position bridging the elongate direction of the passage and being located above the lower surface of the body section and below the surface segment of the body section, said band impeding member and cooperating guide member being closely spaced to each other to define a passageway there between that is sufficiently close together to engage an enlarged connection member of the elastic exercise band to retain the elastic exercise band engaged with the pushup device while permitting a body section of the elastic exercise band to pass freely through the passageway.

16. A pushup device for use with a like pushup device during one or more pushups, said pushup device includes a body section having a lower surface for engaging a support surface and an upper handle section attached to the body section for engagement by a person desiring to do pushups; said device further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer, said pushup device including one or more band impeding members that are located above the lower surface of the body section that is adapted to engage a support surface and below the surface segment of the body section defining a passage through the body section, said one or more band impeding members being pivotally attached to the body section adjacent elongate ends of the passage.

17. A pushup device for use with a like pushup device during one or more pushups, said pushup device includes a body section having a lower surface for engaging a support surface and an upper handle section attached to the body section for engagement by a person desiring to do pushups; said device further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer, said pushup device further including at least one band impeding member that is located above the lower surface of the body section that is adapted to engage a support surface and below the surface segment of the body section defining a passage through the body section, said at least one band impeding member being pivotally attached to the body section adjacent an elongate end of the passage.

18. A pushup device for use with a like pushup device during one or more pushups, said pushup device includes a body section having a lower surface for engaging a support surface and an upper handle section attached to the body section for engagement by a person desiring to do pushups; said device further including at least one retainer for engaging a cooperating connection member adjacent an end of a stretchable elastic exercise band; said body section including a surface segment spaced upwardly from the lower surface for providing a passage extending in an elongate direction from one end of said body section to an opposed end of said body section, said passage being adapted to receive an end segment of an elastic exercise band therethrough when said cooperating connection member at an end of the elastic exercise band is engaged by said at least one retainer, wherein the body section thereof includes at least one band-impeding member thereon located above the lower surface of the body section that is adapted to engage the support surface and below the surface segment of the body section defining a passage through the body section, said body section further including at least one band guiding member, said at least one band guiding member being closely spaced to, and cooperating with said at least one band impeding member, wherein said at least one band guiding member and cooperating band impeding member are spaced-apart to provide a passageway there between for receiving a body section of an elastic exercise band therethrough, said passageway being too small to permit a connection member of the exercise band from passing therethrough, said at least one cooperating band impeding member and band guiding member constituting a retainer on the body section of the pushup device for engaging a connection member of the exercise band located at an end of the exercise band, said band impeding member being pivotally attached to the body section adjacent an elongate end of said passage.

* * * * *